US006585401B2

(12) United States Patent
Akizuki et al.

(10) Patent No.: US 6,585,401 B2
(45) Date of Patent: Jul. 1, 2003

(54) LIGHT SOURCE BULB OF LIGHTING DEVICE FOR VEHICLE

(75) Inventors: Kunio Akizuki, Isehara (JP); Yasumitsu Nakabayashi, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 0 days.

(21) Appl. No.: 09/951,498

(22) Filed: Sep. 14, 2001

(65) Prior Publication Data

US 2002/0034077 A1 Mar. 21, 2002

(30) Foreign Application Priority Data

Sep. 19, 2000 (JP) ..... 2000-284283
Sep. 19, 2000 (JP) ..... 2000-284287

(51) Int. Cl.[7] ..... F21V 11/00

(52) U.S. Cl. ..... 362/508; 362/277; 362/280; 362/512; 362/523; 362/531; 362/285

(58) Field of Search ..... 362/512, 313, 362/351, 538, 539, 277, 280, 508, 523, 526, 531, 285, 286, 418

(56) References Cited

U.S. PATENT DOCUMENTS 4,675,794 A * 6/1987 Fink, Jr. et al. ..... 362/289
4,729,065 A * 3/1988 Bahnemann et al. ..... 362/18
4,855,884 A * 8/1989 Richardson ..... 362/278
5,047,902 A * 9/1991 Neumann et al. ..... 362/61
5,086,379 A * 2/1992 Denison et al. ..... 362/145
5,465,195 A * 11/1995 Jenner et al. ..... 362/61
5,971,574 A * 10/1999 Taniuchi et al. ..... 362/508
6,247,835 B1 * 6/2001 Taniuchi ..... 362/524
6,300,718 B1 * 10/2001 Taniuchi et al. ..... 315/82
6,428,187 B1 * 8/2002 Shin ..... 362/286

FOREIGN PATENT DOCUMENTS

JP 2000-040414 2/2000

* cited by examiner

*Primary Examiner*—Sandra O'Shea
*Assistant Examiner*—Jacob Y. Choi
(74) *Attorney, Agent, or Firm*—Foley & Lardner

(57) ABSTRACT

A sliding contact is formed by a first terminal 40 fixed to a side of a lamp base flange 2 and a second terminal 41 fixed to a side of a slider 7. Accordingly, it is possible to supply an electric current to a glass tube 9 without bending a harness 3. Therefore, a harness 3 is not deteriorated, and a resistance at a time of sliding the glass tube 9 is not increased.

15 Claims, 7 Drawing Sheets

LIGHT SOURCE BULB OF LIGHTING DEVICE FOR VEHICLE

BACKGROUND OF THE INVENTION

1. Field of the Invention

The present invention relates to a light source bulb of a lighting device for a vehicle structured such as to longitudinally slide only a glass tube so as to switch between a high beam and a low beam.

2. Description of the Related Art

Since a high intensity discharge (HID) has only one luminous source, in order to switch between a high beam and a low beam by one luminous source, it is necessary to slide a light source bulb in a direction of an optical axis, as is known in Japanese Patent Application Laid-Open No. 2000-40414. Particularly, the structure is made such that a plate holding a bulb is provided in an attaching portion of a lamp housing, the plate is urged toward a low beam position by a spring, and the plate is moved backward toward a high beam position by a solenoid provided in an outer portion of the lamp housing. That is, when turning on the solenoid, a whole of the light source bulb is moved backward so as to form the high beam, and when turning off the solenoid, the whole of the light source bulb is moved forward due to a spring force so as to be switched to the low beam.

However, in the related art described above, since the whole of the light source bulb is moved by the solenoid provided in the outer portion of the lamp housing, a slide resistance between the light source bulb and the lamp housing is increased, and a position of the luminous portion (a filament and an electric discharge portion) is changed during the movement, so that there is a risk that a predetermined light distribution pattern can not be obtained.

Accordingly, there can be considered a structure in which only the glass tube among the light source bulbs is longitudinally slid without longitudinally sliding the whole of the light source bulb. However, in the case of connecting a harness introduced to the light source bulb itself from the external portion to the glass tube within the light source bulb, the harness is bent at each time of longitudinally sliding the glass tube, so that a deterioration of the harness is caused. Further, in order to longitudinally slide the glass tube while bending the harness, a large driving force is required in correspondence thereto, and a size of a power source (a motor, a solenoid or the like) for driving the glass tube and a power transmission mechanism is increased, so that an increase of size of a whole of the lighting device for the vehicle. Accordingly, it is expected to provide an electric power supply structure for the glass tube which prevents the harness from being deteriorated and generates no slide resistance.

SUMMARY OF THE INVENTION

The present invention is made by taking the problems in the related art described above into consideration, and an object of the present invention is to provide a light source bulb of a lighting device for a vehicle which can supply an electric power to a glass tube while preventing a deterioration of a harness and generating no slide resistance even in a structure of sliding only the glass tube.

In accordance with a first aspect of the present invention, there is provided a light source bulb of a lighting device for a motor vehicle which is mounted to a lamp base portion on the basis of a standard set for the light source bulb for the motor vehicle, comprising: a cylindrical lamp base flange attached to the lamp base portion; a case integrally or separately formed in a rear portion of the lamp base flange and having a space sequential to the lamp base flange; a slider received within the lamp base flange in a state of being capable of sliding in a longitudinal direction; a glass tube fixed to a front portion of the slider; and a driving portion received within the case and connected to the slider so as to longitudinally slide the slider.

In accordance with the invention described in the first aspect, since only the glass tube fixed to the slider is longitudinally slid, in an inner portion of the lamp base portion, no great slide resistance is generated at a time of sliding the glass tube, and an accuracy of position of the glass tube is high. Further, the driving portion for moving the glass tube can be achieved by a compact structure which can be received within the light source bulb, so that the size of the lighting device is never increased. Since the light source bulb corresponds to the standard of the lamp base portion, it is not necessary to change the lamp base portion to a structure that does not meet the standard, so that general-purpose properties can be made high.

Further, the structure may be made such that the glass tube is positioned within a substantially cylindrical fixed shade fixed to the lamp base flange, and a notch portion for allowing a light divergence upward from the glass tube is formed in an upper portion of the fixed shade.

In accordance with this structure, since the fixed shade is fixed to the lamp base flange, it is possible to shut out the downward light which reflects by a lower portion of a reflector so as to form an upward glare light.

Further, the structure may be made such that a movable shade forward extended to the above of the glass tube is formed in an upper portion of the slider so as to shut out the light diverging to an oblique rear direction from the glass tube on the basis of a predetermined orientation property.

In accordance with the structure described above, since the movable shade moving together with the glass tube is formed in the upper portion of the slider, it is possible to always shut out the light diverged to the oblique rear direction from the glass tube on the basis of the same orientation property even when sliding the glass tube in the longitudinal direction. Accordingly, it is possible to securely irradiate the light which is reflected by the upper portion of the reflector from the glass tube so as to form a high beam orientation and a low beam orientation, on the basis of an ideal orientation pattern.

Further, the structure may be made such that the lamp base flange except the front portion to which a waterproof cap is closely attached and a waterproof property can be secured, and a case are formed so as to have a waterproof structure.

In accordance with the structure described above, since the rear portion of the lamp base flange out of the waterproof area achieved by the waterproof cap and the case are formed in the waterproof structure, there is no problem in the case that the driving portion including an electric system is received within the case. As the waterproof structure, there can be employed a coating by a waterproof tube in a boundary portion between the lamp base flange and the case, an interposition of a seal member or an O-ring to the boundary portion, an integral formation between the lamp base flange and the case, and the like.

Further, the structure may be made such that the driving portion is formed as a bidirectional solenoid.

In accordance with the structure described above, since the driving portion is the bidirectional solenoid and an electric current application time is short, there is generated no thermal problem even in the case that the driving portion is received within the case.

Further, the structure may be made such that the driving portion is a piston which longitudinally slides due to an air or an oil within the case.

In accordance with the structure described above, since the driving portion is the piston driving within the case, the driving portion is electrically free and is strong against a moisture and an impact. It is possible to widely secure an amount of slide, and it is possible to obtain a greater slide force than the solenoid.

Further, the structure may be made such that the glass tube is of an HID type and the standard of the lamp base portion corresponds to H4.

In accordance with the structure described above, the HID bulb can be replaced while satisfying a beam switching performance of the lighting device for the motor vehicle set on the basis of the H4 bulb. Further, since the lamp base shape corresponds to the standard of the H4 bulb, the waterproof structure can be commonly used as the waterproof cap before being replaced, and it is possible to replace without providing a specific structure, so that it is possible to improve the general-purpose properties. The structure is not limited to the H4 bulb, and the same effect can be obtained in the case of HX bulb.

Further, the structure may be made such that a protrusion and a groove are engaged between an inner surface of the lamp base flange and an outer surface of the slider so as to prevent the slider from rotating, and an air vent is formed in a gap between the protrusion and the groove.

In accordance with the structure described above, since the air can have access from the air vent even when a sealing density is increased in order to increase an accuracy of position between the inner surface of the lamp base flange and the outer surface of the slider, it is possible to smoothly slide the slider. Further, it is possible to properly slide along a baffle.

DETAILED DESCRIPTION OF THE PREFERRED EMBODIMENTS

Figure 1:
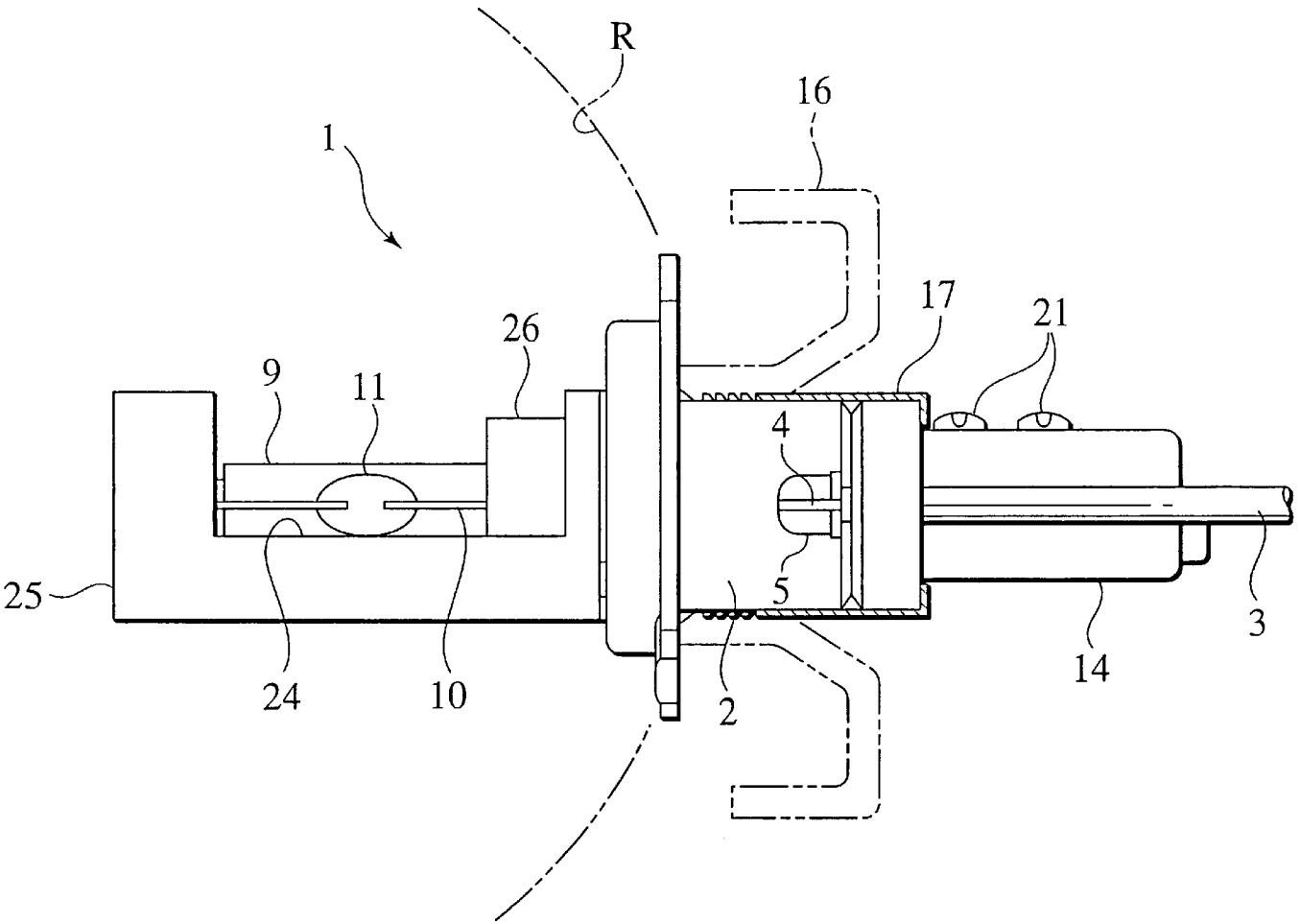
FIG. 1 is a side view showing a light source bulb in accordance with a first embodiment of the present invention.
Figure 2:
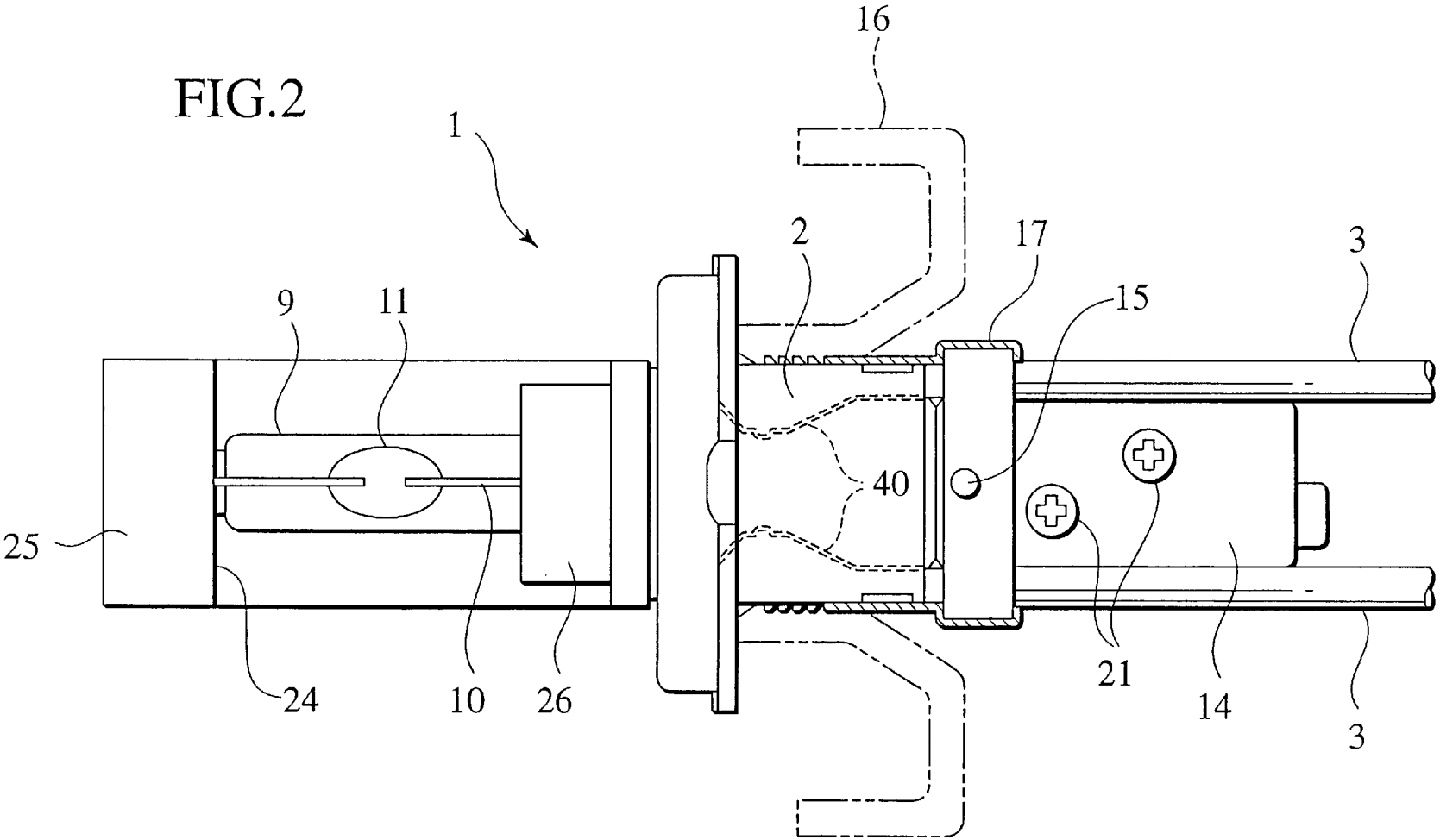
FIG. 2 is a plan view showing the light source bulb shown in FIG. 1.
Figure 3:
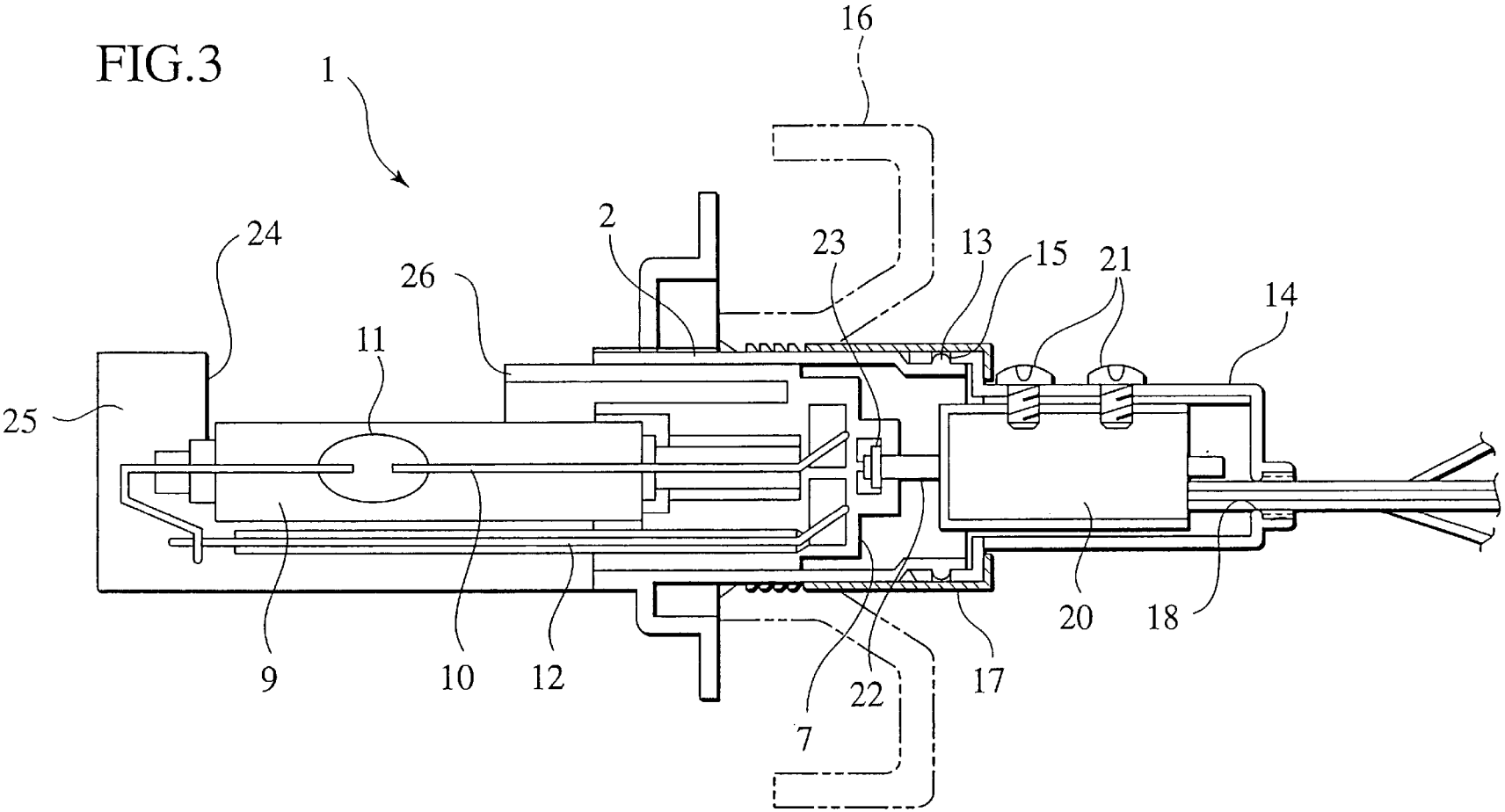
FIG. 3 is a vertical cross sectional view of the light source bulb shown in FIG. 1.
Figure 4:
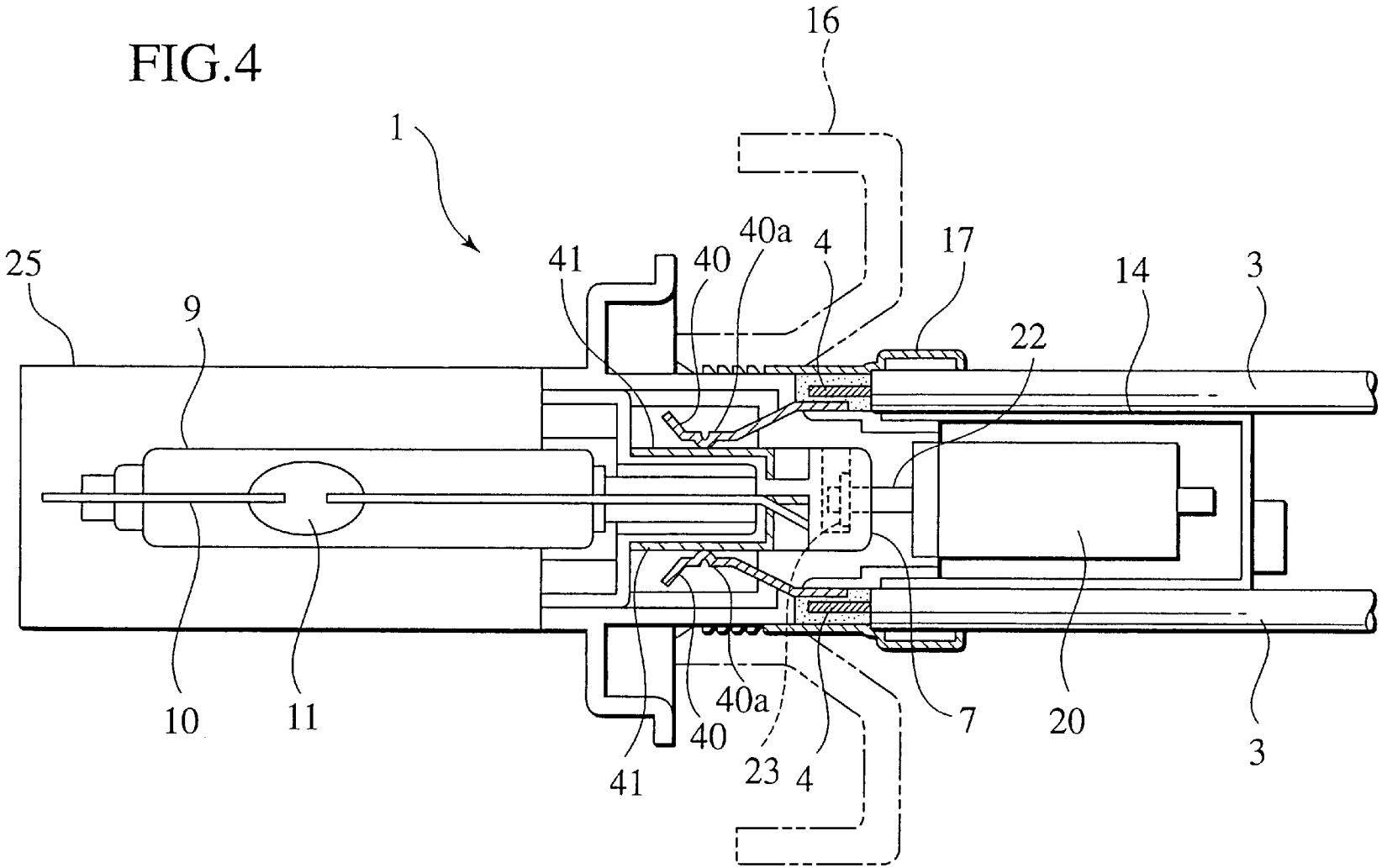
FIG. 4 is a horizontal cross sectional view of the light source bulb in a state of forward sliding a glass tube shown in FIG. 1.
Figure 5:
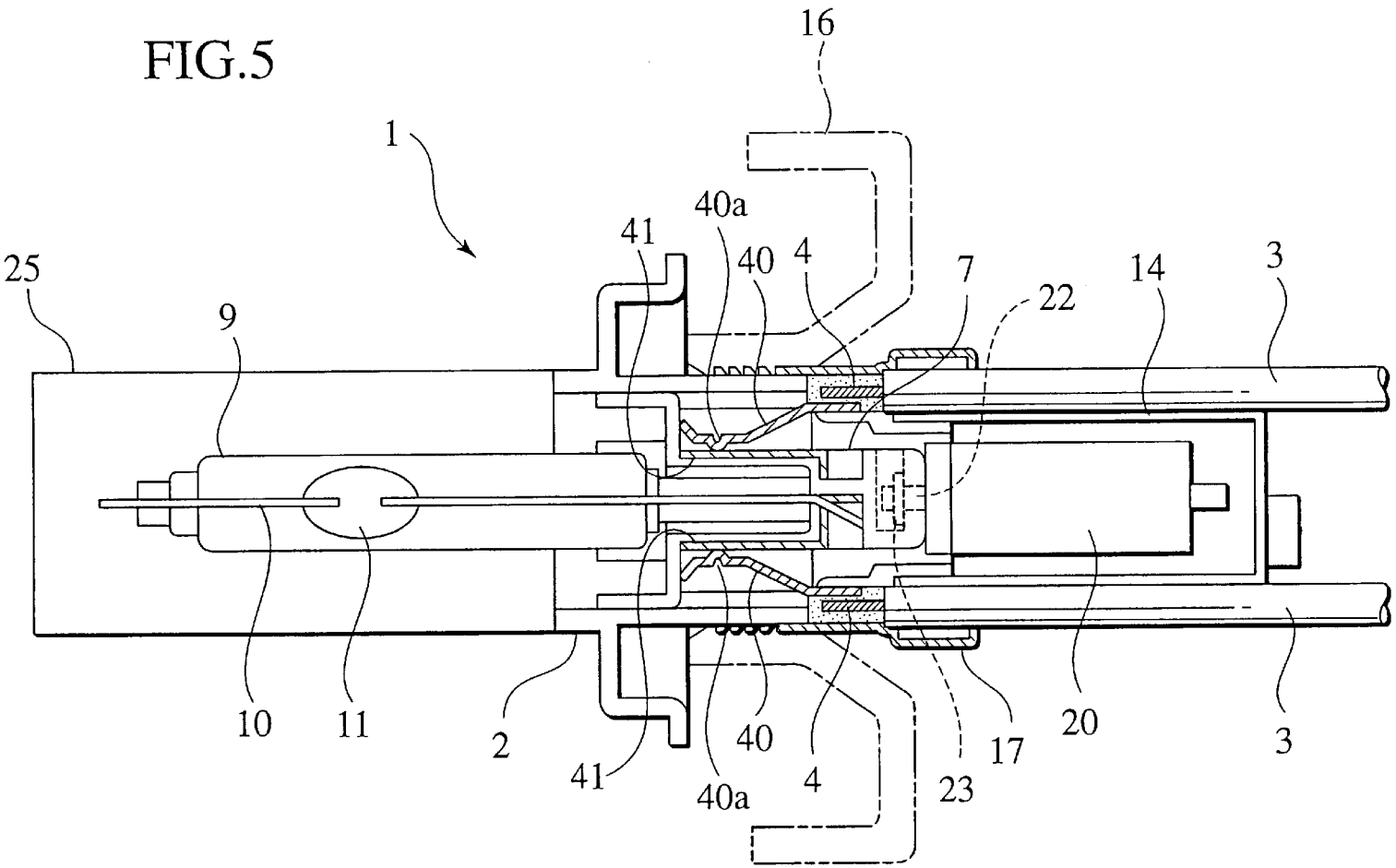
FIG. 5 is a horizontal cross sectional view of the light source bulb in a state of rearward sliding the glass tube shown in FIG. 1.
Figure 6:
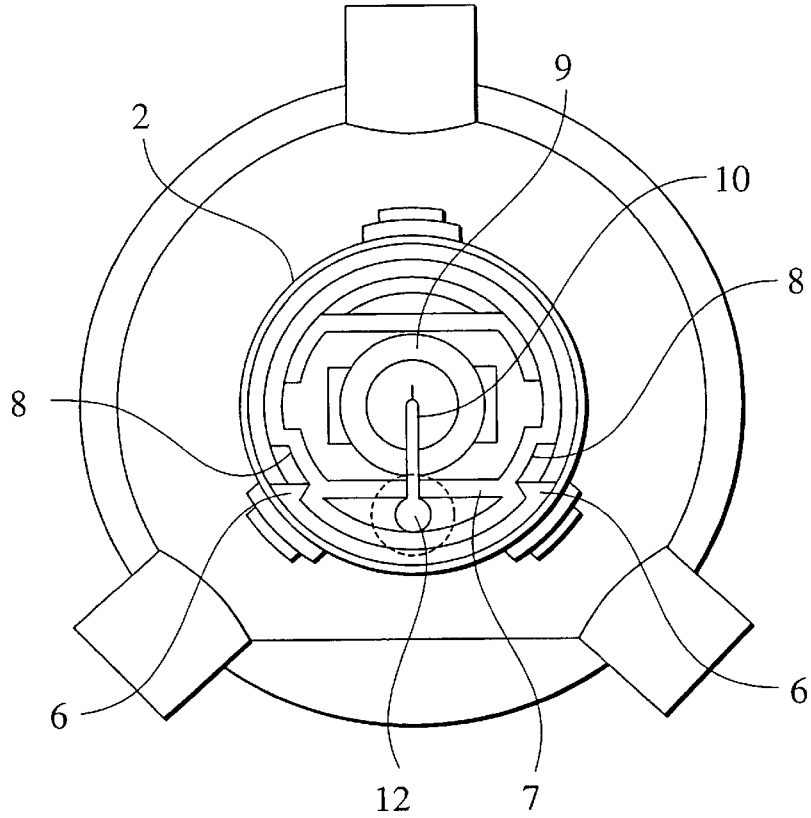
FIG. 6 is a cross sectional view showing an overlapping portion between a lamp base flange and a slider.

A description will be given below of preferred embodiments in accordance with the present invention with reference to the accompanying drawings.

<First Embodiment>

FIGS. 1 to 7 are views showing a first embodiment in accordance with the present invention. The embodiment relates to a head lamp of a motor vehicle. The head lamp is structured such that a light source bulb 1 is provided in a lamp housing (not shown) having a lens on a front surface thereof and having a reflector Rat a rear portion thereof. The light source bulb 1 corresponds to an H4 standard, and is structured such as to be mounted as it is to an attaching portion (not shown) of the H4 standard provided in the lamp housing.

The light source bulb 1 is provided with a lamp base flange 2 having an outer diameter capable of being attached to the attaching portion of the H4 standard. Two harnesses 3 are inserted to the lamp base flange 2 from a rear side, and a core line 4 is exposed to a front end thereof. A first terminal 40 having an obliquely extending portion is attached to an inner side of the core line 4, an opening 5 (refer to FIGS. 1 and 4) is formed in the lamp base flange 2 disposed in an upper side of the core line 4, and the core line 4 and the first terminal 40 are made in a conductive state by a solder injected from the opening 5. A silicone is injected to a portion above the solidified solder. Further, two protrusions 6 (refer to FIG. 6) extending in a longitudinal direction along an optical axis are formed in a lower portion of an inner surface of the lamp base flange 2.

A slider 7 is inserted within the lamp base flange 2 in such a manner as to freely slide in a longitudinal direction. Two grooves 8 are formed along the longitudinal direction on side surfaces of the slider 7. The protrusions 6 formed on the inner surface of the lamp base flange 2 are engaged with lower end surfaces of the grooves 8. Due to an engagement between the groove portions 8 and the protrusions 6, the slider 7 is prevented from being rotated at the lamp base flange 2, and it is possible to prevent the slider 7 from being mounted in a vertically inverted manner.

Further, a gap between the groove 8 and the protrusion 6 forms an air vent. That is, due to the air vent, the lamp base flange 2, the case 14 and the slider 7 have a high sealing property for the purpose of increasing an accuracy of position, and the air can freely have access for the purpose of preventing a pressure of the air within the lamp base flange 2 from being increased at a time when the slider 7 slides.

A glass tube 9 of HID is fixed to a front portion of the slider 7 by a cement (an adhesive agent). An electric power supply source line 10 passes through a center of the glass tube 9, and one luminous portion 11 is provided in the middle thereof. The electric power supply source line 10 is connected to an earth line 12 at a front end of the glass tube 9, and the earth line 12 is returned to a side of a base end portion.

Second terminals 41 are respectively mounted to opposing positions to the side surfaces of the slider 7 along a longitudinal direction. A terminal of the electric power supply source line 10 is soldered to one second terminal 41, and a terminal of the earth line 12 is soldered to another second terminal 41. Both of the second terminals 41 have flat surfaces along the longitudinal direction, and make inward extending portions of the first terminal 40 in contact with the surfaces. In this case, convex portions 40*a* are provided on the inward extending portions of the first terminals 40 toward the direction of the second terminals, and the first terminals 40 and the second terminals 41 are conducted by the convex portion 40*a*. Further, the inward extending portions of the first terminals 40 are bent in the direction of the second terminals and have a spring property.

A contact between the first terminals 40 and the second terminals 41 can be kept good by the spring property.

Projections 13 are formed at opposing positions around a rear end of the lamp base flange 2, and hole portions 15 formed at a front end of the case 14 are engaged therewith, thereby mounting the case 14 to the lamp base flange 2. The case 14 is formed in a container shape having a rear end closed, and forms a space connected to the lamp base flange 2. In this case, the harness 3 mounted to the lamp base flange 2 passes through a part of the case 14 (refer to FIG. 4).

A waterproof cap 16 is closely attached to a side surface of the lamp base flange 2 so as to form a waterproof area in a front side thereof, whereby the water is prevented from entering to a side of the glass tube 9. A rear side of the waterproof cap 16 is not a waterproof area achieved by the waterproof cap 16, however, a waterproof between the both can be kept by coating the boundary portion between the lamp base flange 2 and the case 14 by a waterproof tube 17 from an outer side. Accordingly, the water does not enter within the lamp base flange 2 and the case 14. A solenoid code hole 18 is formed on a rear surface of the case 14, however, since the solenoid hole 18 is waterproofed by a waterproofing means such as a silicone adhesive agent, a rubber bush or the like, no water enters therefrom.

A solenoid 20 corresponding to a driving portion is fixed to the inner portion of the case 14 by a screw 21. The solenoid 20 is of a both-parties type, and can alternately switch between a state that a pin 22 protrudes out and a state that the pin 22 is retracted at each time of applying an electric current, and after the pin 22 stops, the state is kept by an internal magnet, and it is unnecessary to apply an electric current. Accordingly, since the solenoid 20 has a low power and a short time for electric current, the solenoid 20 does not generate a heat within the case 14. Further, as described above, since a waterproof property is kept by the waterproof tube 17, the internal solenoid 20 is not adversely affected by the water.

A front end of the pin 22 of the solenoid 20 is connected to the rear end of the slider 7 by an E ring 23. This connection has a "play" for an angle change of the pin 22, and is structured such that even when the pin 22 does not always coincide with the optical axis due to a mounting way of the solenoid 20, it is possible to securely transmit the driving force of the solenoid 20 to the slider 7. Accordingly, it is possible to longitudinally slide the glass tube 9 fixed to the slider 7 by driving the solenoid 20.

Figure 7:
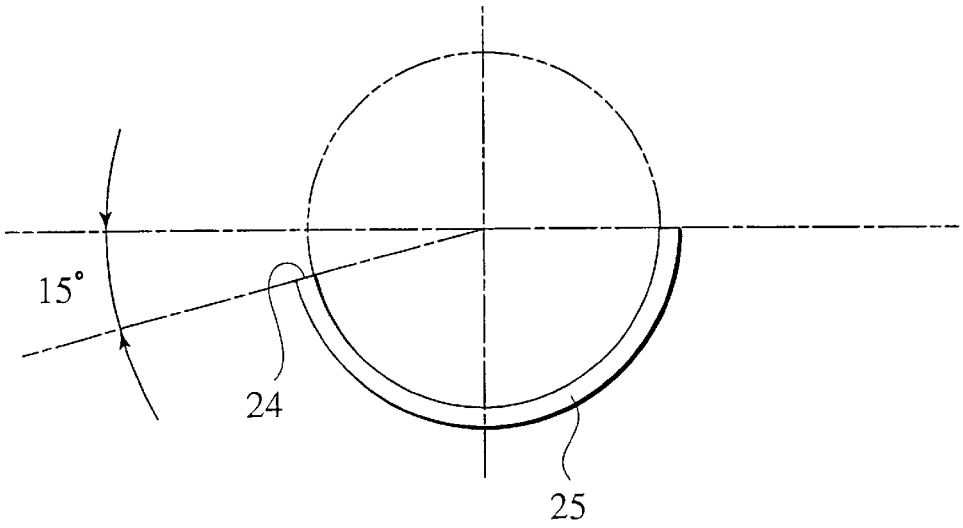
FIG. 7 is a cross sectional view of a fixed shade showing a position of a cut line of a notch portion.

A substantially cylindrical fixed shade 25 having a notch portion 24 on the big side in an upper portion thereof is fixed to a front portion of the lamp base flange 2, and the glass tube 9 is positioned within the fixed shade 25. This fixed shade 25 is provided for the purpose of shutting off a downward light which is reflected by the lower portion of the reflector R so as to form an upward glare light, and cut lines in both sides of the notch portion 24 are set at positions 15 degrees descended from a center position, as shown in FIG. 7.

Further, a movable shade 26 forward extended to the above of the glass tube 9 is formed in the upper portion of the slider 7. The movable shade 26 is structured such as to shield the light diverging to the oblique rear direction from the glass tube 9 on the basis of a predetermined orientation property. Since the movable shade 26 slides together with the glass tube 9, it is possible to always shield the light diverging to the oblique rear direction from the glass tube 9 on the basis of the same orientation property.

Accordingly, if the pin 22 of the solenoid 20 is protruded so as to forward slide the slider 7 and the glass tube 9 (FIG. 4), the light reflected by the upper portion of the reflector R forms a low beam, and if the pin 22 is retracted so as to rearward slide the slider 7 and the glass tube 9 (FIG. 5), the light forms a high beam. As described above, in spite of the glass tube 9 of HID having one luminous portion 11, the low beam and the high beam can be switched by forward and backward moving the glass tube 9, so that it is possible to construct a two-lamp type head lamp. Further, as described above, due to the movable shade 26 formed in the slider 7, the light diverging to the obliquely rearward direction from the glass tube 9 can be always shielded on the basis of the same orientation property even when forward and backward moving the glass tube 9, so that it is possible to securely irradiate the light which is reflected by the upper portion of the reflector from the glass tube 9 so as to form the high beam and the low beam, on the basis of an ideal orientation pattern.

As described above, in accordance with the light source bulb 1 of the present embodiment, since the sliding contact is formed by the first terminal 40 fixed to the side of the lamp base flange 2 and the second terminal 41 fixed to the side of the slider 7, it is possible to supply an electric power to the glass tube 9. Accordingly, the harness 3 is not deteriorated, and a resistance at a time of sliding the glass tube 9 is not increased. Therefore, it is possible to make the solenoid 20 for driving the glass tube 9 compact, and the solenoid 20 can be easily received within the light source bulb 1.

Further, since only the glass tube 9 fixed to the slider 7 is longitudinally slid in the inner portion of the light source bulb 1, a large sliding resistance is not generated at a time of sliding the glass tube 9, and an accuracy of position of the glass tube 9 with respect to the reflector R is high. Further, since the slider 7 fixing the glass tube 9 is connected to the solenoid 20 so as to be directly driven, it is useful for improving the accuracy of position of the glass tube 9 in a sliding direction.

Further, the solenoid 20 for moving the glass tube 9 can be made as compact as capable of being received within the light source bulb 1, and does not cause to increase the size of the head lamp itself. Since the lamp base flange 2 corresponds to the H4 standard of the attaching portion, it is not necessary to change the attaching portion to the structure which does not meet the standard, and it is possible to mount the light source bulb 1 in accordance with the present embodiment as it is, in place of the bulb of ready-made H4 standard, so that general-purpose properties are high.

Further, since the waterproof structure is achieved by coating the rear portion of the lamp base flange 2 deflecting from the waterproof area established by the waterproof cap 16 and the case 14 by the waterproof tube 17, there is generated no problem if the solenoid 20 including an electric system is received within the case 14. As the waterproofing structure, a seal member or an O-ring may be interposed in the boundary portion between the lamp base flange 2 and the case 14 in place of the waterproof tube 17, or the lamp base flange 2 and the case 14 may be integrally formed so as to omit the boundary portion.

<Second Embodiment>

Figure 8:
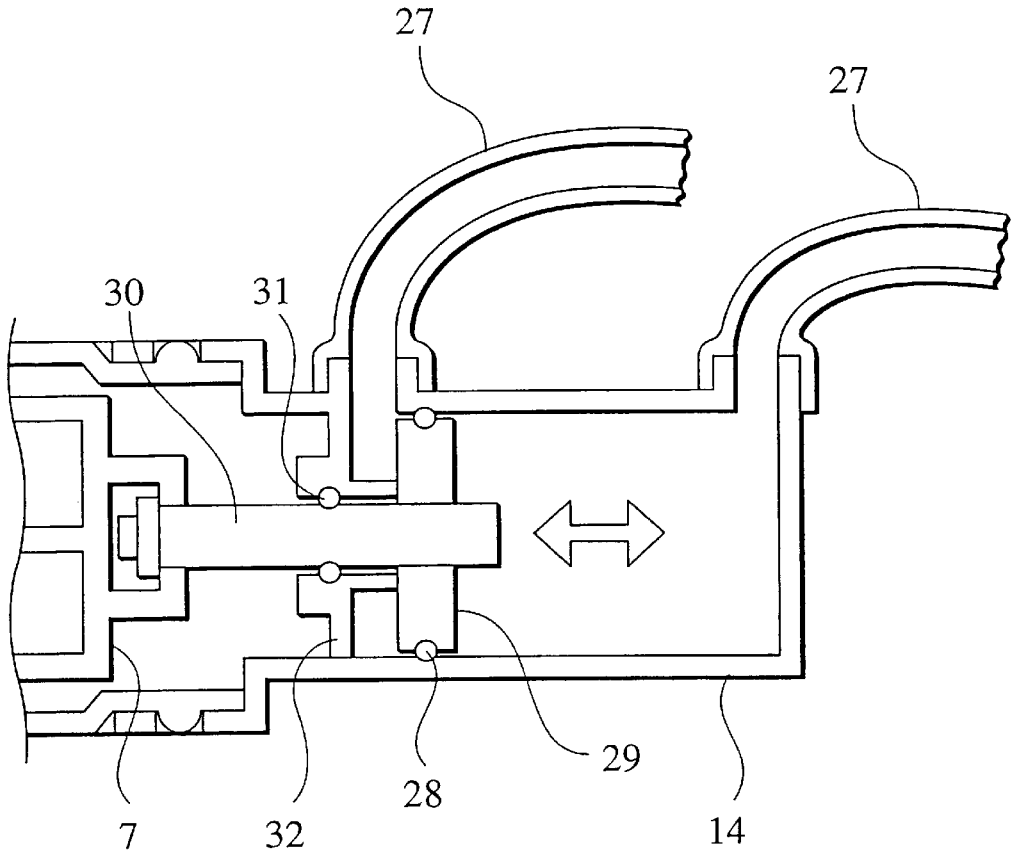
FIG. 8 is a cross sectional view showing a driving portion of a light source bulb in accordance with a second embodiment.

FIG. 8 is a view showing a second embodiment in accordance with the present invention. In this embodiment, hoses 27 are connected to front and rear portions of the case 14, and a piston 29 corresponding to a driving portion in which a peripheral edge is sealed by an O-ring 28 is received within the case 14. A front wall portion 32 extending through a pin 30 of the piston 29 via an O-ring 31 is formed in the case 14. Further, the structure is made such that the piston 29 is longitudinally slid and the slider 7 connected to the pin 30 of the piston 29 is longitudinally slide by alternately injecting an air or an oil into a space in both sides of the piston 29 from the hose 27.

In accordance with this embodiment, since the structure is made such that the piston 29 is longitudinally slid due to a pressure of the air or the oil, the structure is strong against a moisture and an impact. Further, in comparison with the case of the solenoid, it is possible to secure more slide amount and obtain greater slide force.

In this case, the driving portion is not limited to the solenoid or the piston, and may employ the other structures such as a motor as far as it can be received within the case and can securely slide the slider in the longitudinal direction.

What is claimed is:

1. A light source bulb of a lighting device for a motor vehicle, which is mounted to a lamp base portion on the basis of a standard set for the light source bulb for the motor vehicle, comprising:

a cylindrical lamp base flange attached to the lamp base portion;

a case integrally or separately formed in a rear portion of the lamp base flange and forming a space sequential to the lamp base flange;

a slider received within the lamp base flange in a state of being capable of sliding in a longitudinal direction;

a glass tube fixed to a front portion of the slider; and a driving portion received within the case and connected to the slider so as to longitudinally slide the slider;

wherein the glass tube is positioned within a substantially cylindrical fixed shade fixed to the lamp base flange, and wherein a notch portion for allowing a light divergence upward from the glass tube is formed in an upper portion of the fixed shade.

2. The light source bulb of a lighting device for a motor vehicle of claim 1, wherein a movable shade forward extended to above the glass tube is formed in an upper portion of the slider so as to shut out the light diverging to an oblique rear direction from the glass tube on the basis of a predetermined orientation property.

3. The light source bulb of a lighting device for a motor vehicle of claim 1, further comprising a waterproof cap mounted to a side surface of the lamp base flange, wherein the lamp base flange, except the front portion to which the waterproof cap is closely attached and a waterproof property is secured, and the case are formed so as to have a waterproof structure.

4. The light source bulb of a lighting device for a motor vehicle of claim 1, wherein the driving portion is a bidirectional solenoid.

5. The light source bulb of a lighting device for a motor vehicle of claim 1, wherein the driving portion is a piston which longitudinally slides due to an air or an oil within the case.

6. The light source bulb of a lighting device for a motor vehicle of claim 1, wherein the glass tube is of an HID type and the standard of the lamp base portion corresponds to H4.

7. The light source bulb of a lighting device for a motor vehicle of claim 1, further comprising protrusions formed in the lamp base flange, and a pair of grooves formed on side surfaces of the slider and engaging with the protrusions, wherein the slider is prevented by an engagement between the protrusions and the grooves from rotating in the lamp base flange, and an air vent is formed in a gap between the protrusion and the groove.

8. A light source bulb of a lighting device for a motor vehicle structured to longitudinally slide a slider fixing a glass tube within a lamp base portion mounted to an attaching portion on the basis of a standard set for the light source bulb for the motor vehicle, comprising:

a harness fixed to an inner portion of the lamp base flange;

a first terminal connected to a core line at a front end of the harness; and a second terminal being in contact with a part of the first terminal and disposed along a longitudinal direction of a side surface of the slider, wherein a conduction between the first terminal and the second terminal is always maintained, and wherein the glass tube is positioned within a substantially cylindrical fixed shade fixed to the lamp base flange, and wherein a notch portion for allowing a light divergence upward from the glass tube is formed in an upper portion of the fixed shade.

9. The light source bulb of a lighting device for a motor vehicle of claim 8, wherein a movable shade forward extended to above the glass tube is formed in an upper portion of the slider so as to shut out the light diverging to an oblique rear direction from the glass tube on the basis of a predetermined orientation property.

10. A light source bulb of a lighting device for a motor vehicle structured such as to longitudinally slide a slider fixing a glass tube within a lamp base portion mounted to an attaching portion on the basis of a standard set for the light source bulb for the motor vehicle, comprising:

a harness fixed to an inner portion of the lamp base flange;

a first terminal connected to a core line at a front end of the harness;

a second terminal being in contact with a part of the first terminal and disposed along a longitudinal direction of a side surface of the slider;

a case having a space sequential to the lamp base flange integrally or separately formed in a rear portion of the lamp base flange;

a driving portion connected to the slider and longitudinally sliding the slider received within the case; and a waterproof cap mounted to a side surface of the lamp base flange, wherein a conduction between the first terminal and the second terminal is always maintained, wherein the lamp base flange is formed in a cylindrical shape, and wherein the lamp base flange, except the front portion to which the waterproof cap is closely attached and a waterproof property is secured, and the case are formed so as to have a waterproof structure.

11. The light source bulb of a lighting device for a motor vehicle of claim 10, wherein the driving portion is a bidirectional solenoid.

12. A light source bulb of a lighting device for a motor vehicle of claim 10, wherein the driving portion is a piston which drives due to an air or an oil within the case.

13. The light source bulb of a lighting device for a motor vehicle of claim 8, wherein the glass tube is of an HID type and the standard of the attaching portion corresponds to H4.

14. The light source bulb of a lighting device for a motor vehicle of claim 8, wherein the first terminal is bent in a direction of the second terminal, thereby pressing the second terminal.

15. The light source bulb of a lighting device for a motor vehicle of claim 14, wherein a convex-shaped contact provided on the first terminal is in contact with the second terminal.

* * * * *